US008068091B2

(12) United States Patent
Murayama et al.

(10) Patent No.: US 8,068,091 B2
(45) Date of Patent: Nov. 29, 2011

(54) ELECTROPHORETIC DISPLAY DEVICE

(75) Inventors: Tetsuro Murayama, Matsumoto (JP); Yasuhiro Shimodaira, Fujimi (JP)

(73) Assignee: Seiko Epson Corporation (JP)

( * ) Notice: Subject to any disclaimer, the term of this patent is extended or adjusted under 35 U.S.C. 154(b) by 537 days.

(21) Appl. No.: 12/331,540

(22) Filed: Dec. 10, 2008

(65) Prior Publication Data

US 2009/0189850 A1 Jul. 30, 2009

(30) Foreign Application Priority Data

Jan. 29, 2008 (JP) ..... 2008-017875

(51) Int. Cl.
*G09G 3/34* (2006.01)

(52) U.S. Cl. ..... 345/107

(58) Field of Classification Search ..... None
See application file for complete search history.

(56) References Cited

U.S. PATENT DOCUMENTS

2008/0158651 A1* 7/2008 Kawase et al. ..... 359/296
2008/0238867 A1* 10/2008 Maeda et al. ..... 345/107

FOREIGN PATENT DOCUMENTS

JP 2005-114822 4/2005

* cited by examiner

*Primary Examiner* — Paul Huber
(74) *Attorney, Agent, or Firm* — Harness, Dickey & Pierce, P.L.C.

(57) ABSTRACT

An electrophoretic display device includes a pair of substrates, a pixel, a first electrode being formed on one of the substrates for the pixel, a second electrode being formed on the other of the substrates, and an electrophoretic element which is held between the first electrode and the second electrode. The pixel includes a pixel switching element which is connected to a scan line and a data line, a memory circuit which is connected to the pixel switching element, and a switch circuit which is interposed between the memory circuit and the first electrode. The memory circuit is connected with a first power source line and a second power source line, and the switch circuit is connected with a first control line and a second control line. The first power source line and the second power source line cross each other at a first position of the pixel, and the first control line and the second control line cross each other at a second position of the pixel.

6 Claims, 6 Drawing Sheets

ELECTROPHORETIC DISPLAY DEVICE

BACKGROUND

1. Technical Field

The present invention relates to an electrophoretic display device.

2. Related Art

An active matrix type electrophoretic display device includes switching transistors and memory circuits in pixels (for example, see JP-A-2005-114822). In the display device described in JP-A-2005-114822, an electrophoretic element including a plurality microcapsules, in which charged particles are included, are adhered on a device substrate on which pixel switching transistors or pixel electrodes are formed and the electrophoretic element is sandwiched between the device substrate and a counter substrate on which counter electrodes are mounted.

Each of the pixel circuits of the electrophoretic display device is preferably laid out such that a circuit area is reduced in order to realize high-precision display. Accordingly, it is preferable that the number of lines in each of the pixel circuits is small. For example, in each of the pixel circuits of a liquid crystal device which is an example of the display device, one capacitor and one transistor are mainly used. In this circuit, a selection transistor connected to a scan line and a data line and a capacitor connected to a ground line or a scan line of an adjacent pixel are configured. A line which is necessary in each of the pixel circuits is only a line for connecting the transistor and the capacitor and a line with the ground line or wiring area between the pixel circuits offers no problem.

In contrast, each of the pixel circuits of the electrophoretic display device includes a latch circuit as a memory circuit and two transmission gates controlled to deliver an external signal to a pixel electrode by data stored in the latch circuit. By this circuit configuration, a display state can be changed to an entirely white image, an entirely black image and a reversed image while maintaining image data in the latch circuit. A driver circuit does not need to be operated except when a new image is displayed and a flexible display method can be realized.

However, in each of the pixel circuits having the latch circuit and the transmission gates, a pixel selection switch circuit, the latch circuit and the transmission gates need to be included in a layout region of one pixel; and connection of lines for connecting these components, positive and negative power source lines connected to the latch circuits, and global lines called external signal lines are required. If the lines from the global lines are arranged to be longitudinally crossed, the connection between the components needs to avoid the lines, the lines become complicated, and a necessary space is increased. In particular, since a wiring area is increased, an area per pixel is increased and high precision cannot be realized.

If the components such as the pixel selection switch circuit, the latch circuit and the transmission gates are arranged in a restricted area, that is, one pixel, the gap between the lines may be small. In this case, since particles may be attached between the lines and a short circuit may occur in a manufacturing process, yield may deteriorate.

SUMMARY

An advantage of some aspects of the invention is that it provides an electrophoretic display device capable of realizing high precision and preventing yield from deteriorating.

According to an aspect of the invention, there is provided an electrophoretic display device, in which an electrophoretic element including electrophoretic particles is sandwiched between a pair of substrates, a first electrode is formed on one of the substrates for each pixel and a second common electrode is formed on the other of the substrates over a plurality of pixels, each of the pixels includes a pixel switching element connected to a scan line and a data line, a memory circuit connected to the pixel switching element and a switch circuit interposed between the memory circuit and the first electrode, the memory circuit is connected with a first power source line and a second power source line, and the switch circuit is connected with a control line and a second control line, wherein the first power source line and the second power source line cross each other at a first position of each of pixels, and the first control line and the second control line cross each other at a second position of each of the pixels.

According to the invention, in the electrophoretic display device including the memory circuit and the switch circuit in each of the pixels, since the first power source line and the second power source line connected to the memory circuit cross each other at the first position and the first control line and the second control line connected to the switch circuit cross each other at the second position, it is possible to shorten the lines which are longitudinally crossed in each of the pixels. Accordingly, since a space occupied by the lines in each of the pixels can be reduced, it is possible to form a high-precision pixel. In addition, by reducing the space occupied by the lines in each of the pixels, since a margin is provided to the arrangement of the components in each of the pixels in the same resolution and a margin is provided to a distance between the lines, it is possible to prevent yield from deteriorating due to the short circuit or static electricity in the process of manufacturing the electrophoretic display device.

In the electrophoretic display device, each of the pixels may have a rectangular shape in plan view, the first position may correspond to a first corner of the four corners of each of the pixels, and the second position may correspond to a second corner opposing the first corner of the four corners of each of the pixels.

According to the invention, since each of the pixels has a rectangular shape in plan view, the first position corresponds to a first corner of the four corners of each of the pixels, and the second position corresponds to a second corner opposing the first corner of the four corners of each of the pixels, the connection position of the memory circuit and the connection position of the switch circuit can be divided into opposing corners of the pixels. Accordingly, it is possible to prevent the positions of the lines from being concentrated on predetermined points and thus disperse the lines in each of the pixels.

In the electrophoretic display device, the memory circuit may be provided in the vicinity of the first corner of each of the pixels, and the switch circuit may be provided in the vicinity of the second corner of each of the pixels.

According to the invention, since the memory circuit is provided in the vicinity of the first corner of each of the pixels, and the switch circuit is provided in the vicinity of the second corner of each of the pixels, the memory circuit and the switch circuit are provided in the vicinity of the intersections of the lines connected to the circuits. Accordingly, it is possible to minimize the lines connected to the memory circuit and the switch circuit.

In the electrophoretic display device, at least one of the first power source line, the second power source line, the first signal line and the second signal line may be shared by adjacent pixels.

According to the invention, since at least one of the first power source line, the second power source line, the first signal line and the second signal line is shared by the adjacent pixels, it is possible to suppress the number of the first power source line, the second power source line, the first signal line and the second signal line and widen a space in each of the pixels. Accordingly, since a margin is provided to the arrangement of the lines in each of the pixels, it is possible to prevent yield from deteriorating due to the short circuit or static electricity in a manufacturing process.

In the electrophoretic display device, the arrangement of the adjacent pixels which share at least one of the first power source line, the second power source line, the first signal line and the second signal line in plan view may be linearly symmetrical with respect to the shared line.

According to the invention, since the arrangements of the pixels sharing the line in plan view are linearly symmetrical with respect to the line shared by the arrangements, it is possible to suppress the number of the first power source line, the second power source line, the first signal line and the second signal line without significantly changing the arrangement of the lines in each of the pixels.

In the electrophoretic display device, the scan line and the data line may be arranged to be closer to each of the pixels than the line, which is shared by the adjacent pixels, of the first power source line, the second power source line, the first signal line and the second signal line.

According to the invention, the scan line and the data line may be arranged to be closer to each of the pixels than the line, which is shared by the adjacent pixels, of the first power source line, the second power source line, the first signal line and the second signal line, the positions of the scan line and the data line do not need to be separately designed again when the lines are shared.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. In the present embodiment, for example, an electrophoretic display device driven by an active matrix method will be described. In each view used for following description, the scales or the numbers of the actual structures are differentiated from each other in order to recognize the configurations.

Figure 1:
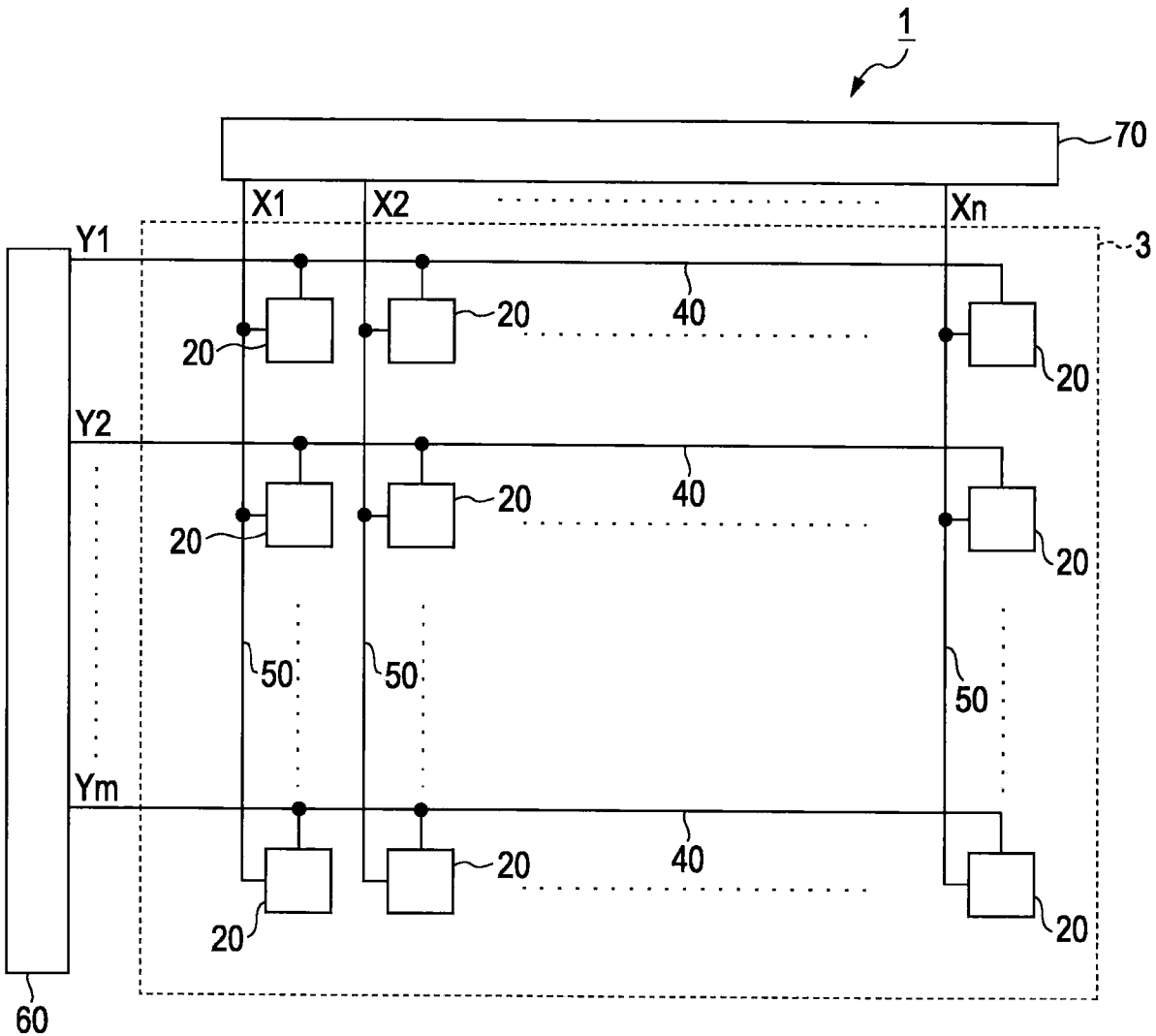
FIG. 1 is a schematic diagram of an electrophoretic display device according to a first embodiment of the invention.

FIG. 1 is a schematic diagram of an electrophoretic display device 1 according to a first embodiment of the invention. The electrophoretic display device 1 includes a display unit 3 in which a plurality of pixels 20 are arranged, a scan line driving circuit 60 and a data line driving circuit 70.

In the display unit 3, a plurality of scan lines 40 (Y1, Y2, . . . , Ym) extending from the scan line driving circuit 60 and a plurality of data lines 50 (X1, X2, . . . , and Xn) extending from the data line driving circuit 70. Pixels 20 are arranged on intersections between the scan lines 40 and the data lines 50 and the pixels 20 are connected to the scan lines 40 and the data lines 50.

Although not shown, in the peripheral portion of the display unit 3, a common power source modulation circuit or a controller is arranged in addition to the scan line driving circuit 60 and the data line driving circuit 70. The controller comprehensively controls the circuits on the basis of image data or synchronization signals supplied from a host device.

A high-potential power source line, a low-potential power source line, a first control line and a second control line are connected from the common power modulation circuit to the pixels 20 in addition to the scan lines 40 and the data lines 50. The common power source modulation circuit generates various types of signals to be supplied to the lines under the control of the controller and performs electrical connection and disconnection (high impedance) of the lines.

Figure 2:
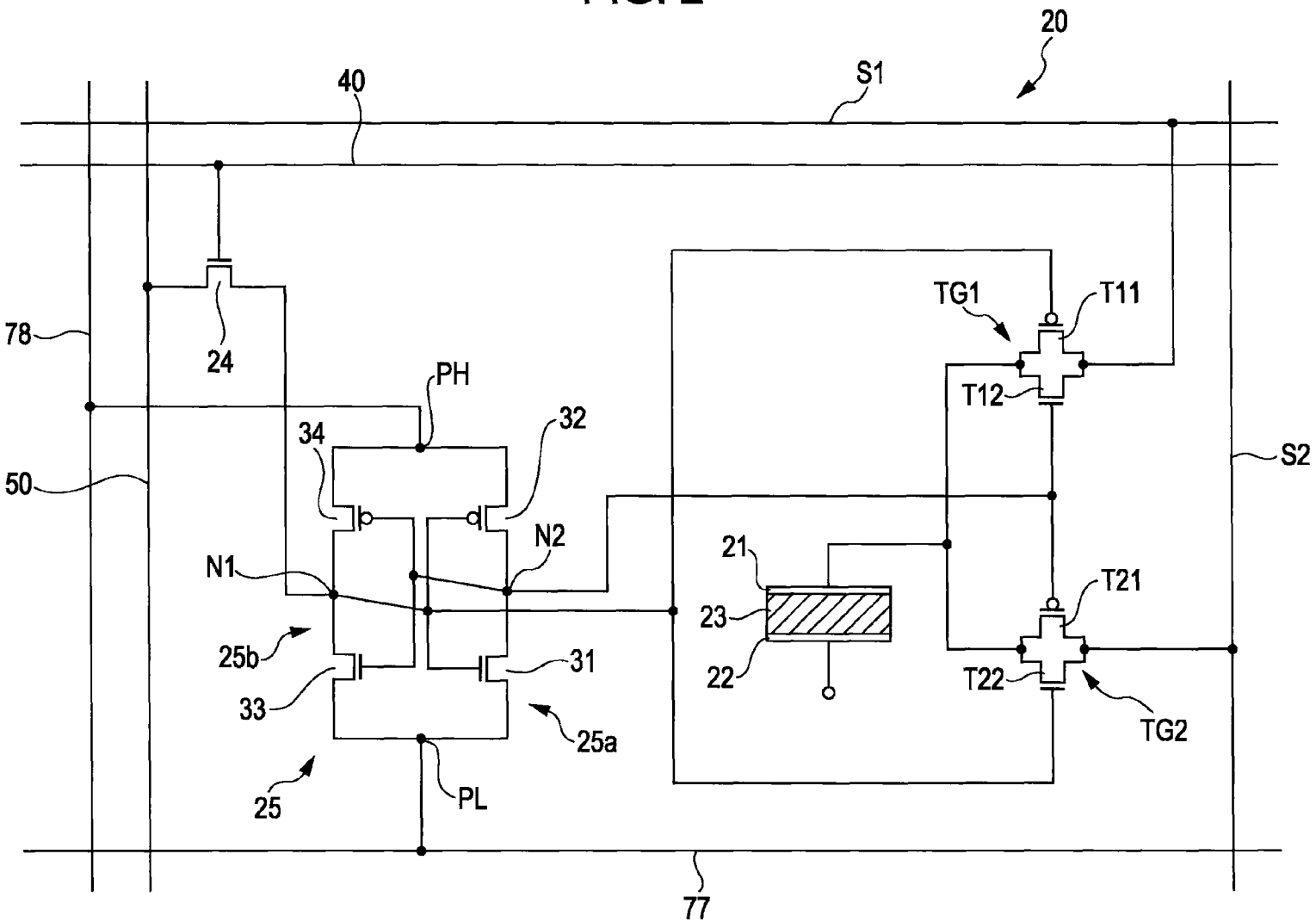
FIG. 2 is a circuit diagram of a pixel of the electrophoretic display device according to the present embodiment.

FIG. 2 is a circuit diagram of each of the pixels 20.

As shown in FIG. 2, each of the pixels 20 includes a pixel switching element 24, a latch circuit (memory circuit) 25, transmission gates TG1 and TG2 which are potential control switch circuits, pixel electrodes 21, a common electrode 22 and an electrophoretic element 23.

The pixel switching element 24 is an N-type field effect transistor. A gate terminal of the pixel switching element 24 is connected with the scan line 40, a source terminal thereof is connected with the data line 50 and a data terminal thereof is connected with an input terminal N1 of the latch circuit 25.

The latch circuit 25 includes a transmission inverter 25*a* and a feedback inverter 25*b* and corresponds to a static random access memory (SRAM) cell.

An output terminal of the transmission inverter 25*a* is connected to an input terminal of the feedback inverter 25*b* and an output terminal of the feedback inverter 25*b* is connected to an input terminal of the transmission inverter 25*a*. That is, the transmission inverter 25*a* and the feedback inverter 25*b* have a loop structure in which the input terminal of one of the inverters is connected to the output terminal of the other of the inverters. The input terminal of the transmission inverter 25*a* (the output terminal of the feedback inverter 25*b*) is the input terminal N1 of the latch circuit 25 and the output terminal of the transmission inverter 25*a* (the input terminal of the feedback inverter 25*b*) is the output terminal N2 of the latch circuit 25. A high-potential power source terminal PH of the latch circuit 25 is connected to a high-potential power source line 78 and a low-potential power source terminal PL thereof is connected to a low-potential power source line 77. The high-potential power source line 78 and the low-potential power source line 77 are arranged in orthogonal to each of the pixels 20.

The transmission inverter 25*a* has an N-type transistor 31 and a P-type transistor 32. Gate terminals of the N-type transistor 31 and the P-type transistor 32 are connected to the input terminal N1 of the latch circuit 25. A source terminal of the N-type transistor 31 is connected to the low-potential power source line 77 and a drain terminal thereof is connected to the output terminal N2. A source terminal of the P-type transistor 32 is connected to the high-potential power source line 78 and a drain terminal thereof is connected to the output terminal N2.

The feedback inverter 25*b* has an N-type transistor 33 and a P-type transistor 34. Gate terminals of the N-type transistor 33 and the P-type transistor 34 are connected to the input terminal N2 of the latch circuit 25 (the drain terminals of the N-type transistor 31 and the P-type transistor 32). A source terminal of the N-type transistor 33 is connected to the low-potential power source line 77 and a drain terminal thereof is connected to the input terminal N1. A source terminal of the P-type transistor 34 is connected to the high-potential power source line 78 and a drain terminal thereof is connected to the input terminal N1.

The transmission gate TG1 has a P-type field effect transistor T11 and an N-type field effect transistor T12. A source terminal of the P-type transistor T11 and a source terminal of the N-type transistor T12 are connected to each other and are connected to a first control line S1. A drain terminal of the P-type transistor T11 and a drain terminal of the N-type transistor T12 are connected to each other and are connected to the pixel electrode 21. A gate terminal of the P-type transistor T11 is connected to the input terminal N1 of the latch circuit 25 and a gate terminal of the N-type transistor T12 is connected to the output terminal N2 of the latch circuit 25.

The transmission gate TG2 has a P-type field effect transistor T21 and an N-type field effect transistor T22. A source terminal of the P-type transistor T21 and a source terminal of the N-type transistor T22 are connected to each other and are connected to a second control line S2. A drain terminal of the P-type transistor T21 and a drain terminal of the N-type transistor T22 are connected to each other and are connected to the pixel electrode 21.

A gate terminal of the P-type transistor T21 is connected to the output terminal N2 of the latch circuit 25 together with the N-type transistor T12 of the transmission gate TG1 and a gate terminal of the N-type transistor T22 is connected to the input terminal N1 of the latch circuit 25 together with the gate terminal of the P-type transistor T11 of the transmission gate TG1. The first control line S1 and the second control line S2 are arranged in orthogonal to each of the pixels 20.

Figure 3:
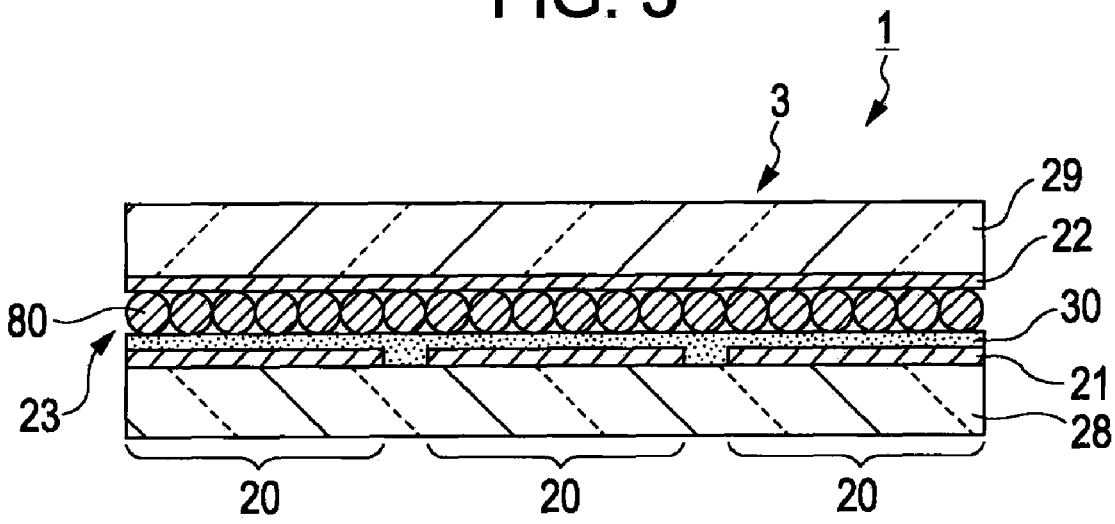
FIG. 3 is a partial cross-sectional view of the electrophoretic display device according to the present embodiment.

FIG. 3 is a partial cross-sectional view of the electrophoretic display device 1 in the display unit 3. In the electrophoretic display device 1, the electrophoretic element 23 in which a plurality of microcapsules 80 are arranged is sandwiched between a device substrate 28 and a counter substrate 29.

In the display unit 3, the plurality of pixel electrodes 21 are arranged on the side of the electrophoretic element 23 of the device substrate 28 and the electrophoretic element 23 is adhered to the pixel electrodes 21 via an adhesive layer 30. The common electrode 22 which has a planar shape and faces the plurality of pixel electrodes 21 is formed on the side of the electrophoretic element 23 of the counter substrate 29 and the electrophoretic element 23 is provided on the common electrode 22.

The device substrate 28 is made of glass or plastic and may not be transparent because it is arranged on a side opposing an image display surface. Although not shown, the scan lines 40, the data lines 50, the pixel switching elements 24 and the latch circuit 25 shown in FIGS. 1 and 2 are formed between the pixel electrodes 21 and the device substrate 28.

The counter substrate 29 is made of glass or plastic and is a transparent substrate because it is provided on an image display side. The common electrode 22 formed on the counter substrate 29 is formed of a transparent conductive material such as magnesium silver (MgAg), indium tin oxide (ITO) or indium zinc oxide (IZO).

The electrophoretic element 23 is formed on the side of the counter substrate 29 in advance and is generally treated as an electrophoretic sheet including the adhesive layer 30. Protective released paper is attached to the side of the adhesive layer 30.

In a manufacturing process, the electrophoretic sheet from which the released paper is stripped is attached to the device substrate 28 on which the pixel electrodes 21 or the circuits manufactured separately are formed so as to form the display unit 3. Accordingly, the adhesive layer 30 exists on only the side of the pixel electrodes 21.

Figure 4:
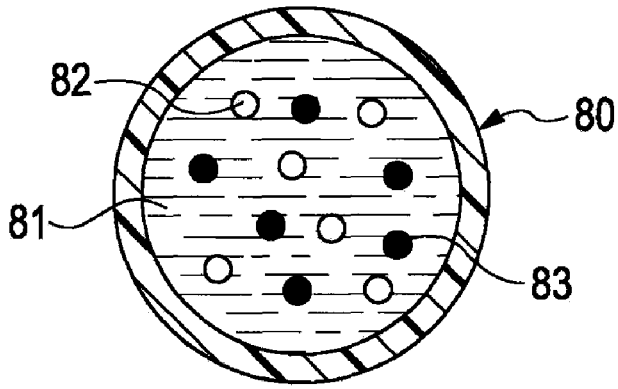
FIG. 4 is a cross-sectional view of a microcapsule of the electrophoretic display device according to the present embodiment.

FIG. 4 is a cross-sectional view of each of the microcapsules 80. Each of the microcapsules 80 has, for example, a particle diameter of about 50 μm and is a spherical body in which a dispersion medium 81, a plurality of white particles (electrophoretic particles) 82 and a plurality of black particles (electrophoretic particles) 83 are filled. As shown in FIG. 3, the microcapsules 80 are sandwiched between the common electrode 22 and the pixel electrodes 21 and one or the plurality of microcapsules 80 are arranged in one pixel 20.

A shell (wall film) of each of the microcapsules 80 is formed of acrylic resin such as polymethylmethacrylate or polyethylmethacrylate or polymer resin having light transmissivity, such as urethane or gum arabic.

The dispersion medium 81 is a liquid for dispersing the white particles 82 and the black 83 in each of the microcapsules 80. As the dispersion medium 81, water, an alcoholic solvent (methanol, ethanol, isopropanol, butanol, octanol, methyl cellosolve or the like), esters (ethyl acetate, butyl acetate or the like), ketones (acetone, methyl ethyl ketone, methyl isobutyl ketone or the like), aliphatic hydrocarbon (pentane, hexane, octane or the like), alicyclic hydrocarbon (cyclohexane, methyl cyclohexane or the like), aromatic hydrocarbon (benzene, toluene, benzenes having a long-chain alkyl group (xylene, hexylbenzene, heptyl benzene, octyl benzene, nonyl benzene, decyl benzene, undecyle benzene, dodecyl benzene, tridecyle benzene, tetradecyl benzene, or the like), halogenated hydrocarbon (methylene chloride, chloroform, carbon tetrachloride, 1,2-dichloroethane or the like), or carboxylate may be used or other oils may be used. These materials may be solely used or a mixture thereof may be used. A surfactant may be added to these materials.

Each of the white particles 82 is, for example, a particle (polymer or colloid) formed of a white pigment such as titanium dioxide, zinc oxide or antimony trioxide and is, for example, negatively charged. Each of the black particles 83 is, for example, a particle (polymer or colloid) formed of a black pigment such as aniline black or carbon black and is, for example, positively charged.

An electrolyte, a surfactant, a metal soap, resin, rubber, oil, varnish, a charge control agent formed of particles of a compound, a titanium-based coupling agent, an aluminum-based coupling agent, a silane-based coupling agent, a lubricant agent or a stabilizing agent may be added to the pigment, if necessary.

Figure 5:
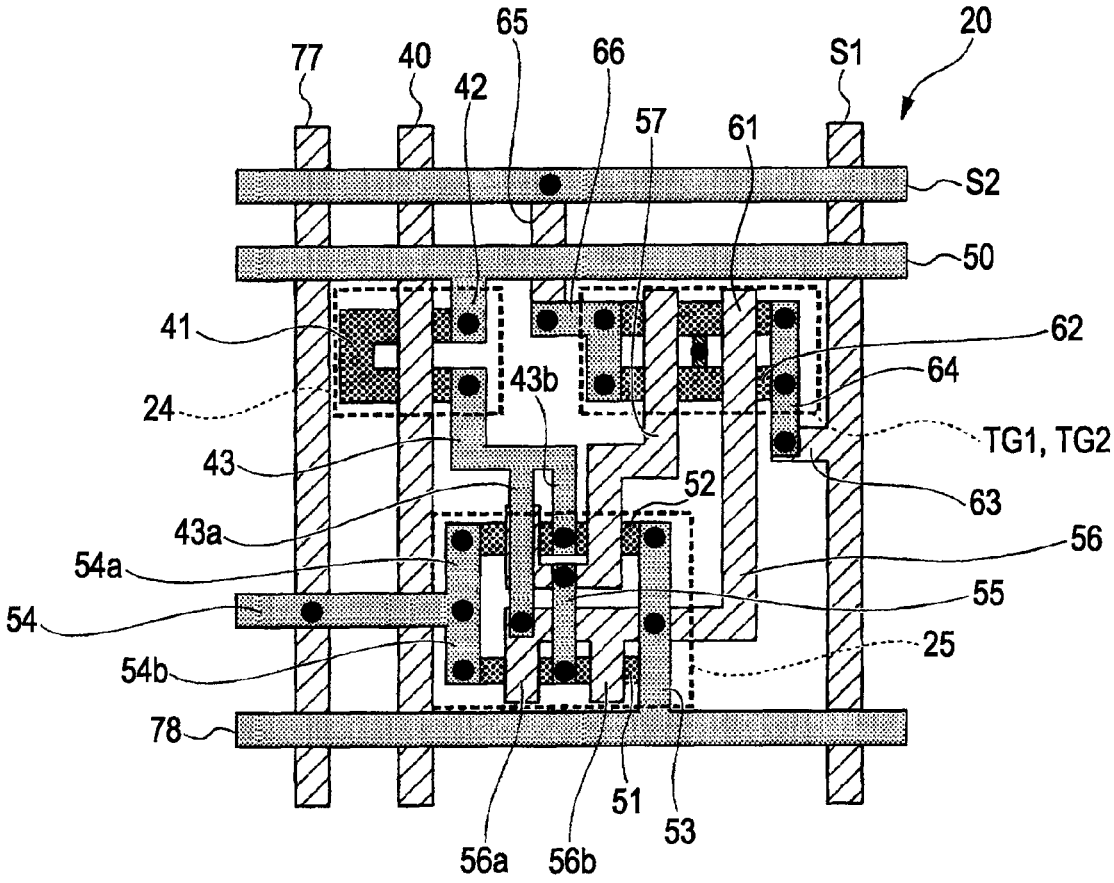
FIG. 5 is a plan view showing a configuration of one pixel of the electrophoretic display device according to the present embodiment.

FIG. 5 is a plan view showing the configuration of one pixel 20 in the electrophoretic display device 1 according to the present embodiment.

As shown in FIG. 5, the pixel 20 has a three-layer structure. A semiconductor layer is provided on a first layer which is a lowermost layer. The lines are formed on a second layer which is higher than the first layer and a third layer which is higher than the second layer. The layers are insulated by insulating layers (not shown).

First, the line provided in the outer circumference of the pixel 20 will be described. In the outer circumference of the pixel 20, the scan line 40, the data line 50, the high-potential power source line 78, the low-potential power source line 77, the first control line S1 and the second control line S2 are provided. These lines are formed over the plurality of pixels 20. Among them, the scan line 40 and the data line 50 are orthogonal to each other at the left upper corner of the pixel 20. The high-potential power source line 78 and the low-potential power source line 77 are orthogonal to each other at the left lower corner (first position) of the pixel 20. The first control S1 and the second control line S2 are orthogonal to each other at the right upper corner (second position) of the pixel 20. The intersection positions of the lines are provided at different corners of the four corners of the pixel 20. In particular, the intersection position between the high-potential power source line 78 and the low-potential power source line 77 and the intersection position between the first control line S1 and the second control line S2 are arranged at opposing corners of the pixel 20. Among these lines, the scan line 40, the low-potential power source line 77 and the first control line S1 vertically extending in the drawing are formed on the same layer (second layer) and the data line 50, the high-potential power source line 78 and the second control line S2 horizontally extending in the drawing are formed on the same layer (third layer) higher than the second layer.

Next, the configuration of the lines and the semiconductor layer provided in the pixel 20 will be described. Semiconductor layers 41, 51, 52, 61 and 62 are formed on the first layer which is the lowermost layer in the pixel 20. These semiconductor layers are formed of a semiconductor layer such as silicon. The semiconductor layers may be formed of other materials.

The semiconductor layer 41 is arranged at the left upper corner of the pixel 20 and has a U-shape in plan view. Two parallel straight lines of the semiconductor layer 41 having the U-shape extend toward the right side of the drawing and the straight lines are arranged in orthogonal to the scan line 40. The upper and lower ends of the semiconductor layer 41 are formed of regions in which high-concentration impurities are included.

The semiconductor layers 51 and 52 are arranged at the central lower portion of the pixel 20 and have a straight line shape in plan view. The semiconductor layers 51 and 52 are arranged in parallel to a direction along the high-potential power source line 78. The right and left ends and the horizontally central portion of the semiconductor layers 51 and 52 are formed of regions in which high-concentration impurities are included.

The semiconductor layers 61 and 62 are arranged at the right upper portion of the pixel 20 and have a straight line shape in plan view. The semiconductor layers 61 and 62 are arranged in parallel to a direction along the scan line 50. The right and left ends and the horizontally central portion of the semiconductor layers 61 and 62 are formed of regions in which high-concentration impurities are included.

Lines 56, 57, 63 and 65 are formed on the second layer which is higher than the first layer. These lines are formed metal having high conductivity, such as copper, aluminum or silver.

The line 56 includes a portion extending in parallel with the first control line S1 from the right upper region of the pixel to the right lower region of the pixel and a portion extending in parallel to the high-potential power source line 78 from the right lower region of the pixel to the left lower region of the pixel and passing between the semiconductor layer 51 and the semiconductor layer 52 in plan view. In the right upper region of the pixel, the line 56 is formed in orthogonal to the semiconductor layers 61 and 62 and a region between the horizontally central portion and the right end of the semiconductor layers 61 and 62 becomes an orthogonal portion. The line 56 overlaps with the semiconductor layers 61 and 62 in the orthogonal portion in plan view. In the left lower region of the pixel, portions (branched portions 56*a* and 56*b*) of the line 56 branched from two portions thereof to the semiconductor layer 51 are provided. The branched portion 56*a* is provided so as to overlap with a region between the left end of the semiconductor layer 51 and the horizontally central portion thereof in plan view. The branched portion 56*b* is provided so as to overlap with a region between the right end of the semiconductor layer 51 and the horizontally central portion thereof.

The line 57 includes a portion arranged at the left side of the line 56 in the right upper region of the pixel and laid to the central portion of the pixel, and a portion laid from the central region of the pixel to the left lower region of the pixel. In the right upper region of the pixel, the line 57 is formed in orthogonal to the semiconductor layers 61 and 62 and a region between the horizontally central portion and the left end of the semiconductor layers 61 and 62 becomes an orthogonal portion. In the left lower region of the pixel, the line 57 is orthogonal to a region between the right end of the semiconductor layer 52 and the horizontally central portion thereof. The line 57 is laid between the semiconductor layer 51 and the semiconductor layer 52 to be orthogonal to a region between the left end of the semiconductor layer 52 and the horizontally central portion thereof. The line 57 overlap with the semiconductor layers 51, 61 and 62 in the orthogonal portion in plan view.

The line 63 is a portion protruding from the first control line S1 toward the inside of the pixel 20 in the left direction and is provided in the right central region of the pixel. The line 65 is vertically provided in the upper central region of the pixel and is laid from the position overlapping with the second control line S2 to the inside of the pixel 20. The upper end of the line 65 is connected to the second control line S2 via a contact hole.

Lines 42, 43, 53, 54, 55, 64 and 66 are formed on the third layer which is higher than the second layer. These lines are formed of metal having high conductivity such as copper, aluminum or silver, similar to the lines formed on the second layer.

The line 42 is a portion protruding from the data line 50 toward the inside of the pixel 20 in the lower direction and is provided in the left upper region of the pixel. The lower end of the line 42 is arranged to overlap with the upper end of the semiconductor layer 41 in plan view. The upper end of the line 65 is connected to the second control line S2 via a contact hole. The lower end of the line 42 and the upper end of the semiconductor layer 41 are connected via a contact hole.

The line 43 is formed from a position overlapping with the lower end of the semiconductor layer 41 in plan view to the left lower region of the pixel. The lower end of the semiconductor layer 41 and the line 43 are connected via a contact hole. In the left lower region of the pixel, the line 43 is branched (a branched portion 43*a* and a branched portion 43*b*). The branched portion 43*a* is formed to overlap with the branched portion 56*a* of the line 56 over the semiconductor layer 52 in plan view. The branched portion 43*a* and the branched portion 56*a* are connected via a contact hole. The branched portion 43*b* is formed to overlap with the horizontally central portion of the semiconductor layer 52 in plan view and the branched portion 43*b* and the semiconductor 52 are connected via a contact hole.

The line 53 is a portion protruding from the high-potential power source line 78 to the inside of the pixel 20 in the upper direction and is provided in the central lower region of the pixel. The line 53 passes through the right end of the semiconductor layer 51 and is formed up to a position overlapping with the right end of the semiconductor layer 52 in plan view. The line 53 is connected to the right ends of the semiconductor layers 51 and 52 in parallel via a contact hole.

The line 54 is a portion formed from a position overlapping with the low-potential power source line 77 in plan view toward the inside of the pixel 20 in the right direction and is provided in the left lower region of the pixel. The line 54 is provided at a position between the semiconductor layer 51 and the semiconductor 52 in the vertical direction and is branched at a position reaching the left ends of the semiconductor layers 51 and 52 in two directions (branched portions 54*a* and 54*b*). The branched portion 54*a* is formed to overlap with the left end of the semiconductor layer 51 in plan view, and the branched portion 54*a* and the left end of the semiconductor layer 51 are connected via a contact hole. The branched portion 54*b* is formed to overlap with the left end of the semiconductor layer 52 in plan view, and the branched portion 54*b* and the left end of the semiconductor layer 52 are connected via a contact hole.

The line 55 is formed between the semiconductor layer 51 and the semiconductor layer 52 in the vertical direction. The lower end of the line 55 is provided to overlap with the horizontally central portion of the semiconductor layer 51 in plan view, and the lower end of the line 55 and the central portion of the semiconductor layer 51 are connected via a contact hole. The upper end of the line 55 is provided to overlap with the portion of the line 57 formed at the lower side of the semiconductor layer 52 in plan view, and the upper end of the line 55 and the line 57 are connected via a contact hole.

The line 64 is formed in the right upper region of the pixel in the vertical direction and is formed to overlap with the right end of the semiconductor layer 61, the right end of the semiconductor layer 62 and the left end of the line 63 in plan view. The line 64 and the semiconductor 61 are connected via a contact hole, the line 64 and the semiconductor layer 62 are connected via a contact hole, and the line 64 and the line 63 are connected via a contact hole.

The line 66 is formed in the central upper region of the pixel and is formed to overlap with the left end of the semiconductor layer 61, the left end of the semiconductor layer 62 and the lower end of the line 65 in plan view. The line 66 and the semiconductor 61 are connected via a contact hole, the line 66 and the semiconductor layer 62 are connected via a contact hole, and the line 66 and the line 65 are connected via a contact hole.

By configuring the above-described layers, for example, the pixel switching element 24 is configured in the left upper region of the pixel, by the semiconductor layer 41, the line 42, the line 43, the scan line 40, and an insulating layer (not shown) between the first layer and the second layer. A portion of the semiconductor layer 41 overlapping with the scan line 40 in plan view becomes a channel region, a portion thereof connected to the data line 50 via the line 42 becomes a source region, and a portion thereof connected to the line 43 becomes a drain region. A portion of the scan line 40 overlapping with the semiconductor layer 41 in plan view configures the gate electrode of the pixel switching element 24.

The semiconductor layers 51 and 52, the lines 53, 54, 55, 56 and 57 and the branched portions 43*a* and 43*b* configure the latch circuit 25. Although not shown, the N-type transistor 31 and the P-type transistor 32 of the transmission inverter 25*a* are configured by the semiconductor layer 51 and the N-type transistor 33 and the P-type transistor 34 of the feedback inverter 25*b* are configured by the semiconductor layer 52.

The transmission gate TG1 including the P-type field effect transistor T11 and the N-type field effect transistor T12 is formed by the semiconductor layer 61 and the transmission gate TG2 including the P-type field effect transistor T21 and the N-type field effect transistor T22 is formed by the semiconductor layer 62.

In the case where such a pixel 20 is formed, the first layer to the third layer are sequentially laminated. Since the lines formed in the pixel 20 are formed on the same layer as the scan line 50, the data line 40, the high-potential power source line 78, the low-potential power source line 77, the first control line S1 and the second control line S2 and a space between the lines is sufficiently ensured, the generation of an electrical short circuit between the lines and static electricity in the manufacturing process is minimized.

The description will be made with reference to FIG. 2.

In the pixel 20 having the above-described configuration, if image data having a low level is input from the data line 50 to the latch circuit 25 via the pixel switching element 24, a low level is output from the input terminal N1 of the latch circuit 25 and a high level is output from the output terminal N2. Accordingly, only the P-type transistor T11 and the N-type transistor T12 configuring the transmission gate TG1 are turned on. Accordingly, the pixel electrode 21 is electrically connected to the first control line S1.

In contrast, if image data having a high level is input from the data line 50 to the latch circuit 25 via the pixel switching element 24, a high level is output from the input terminal N1 and a low level is output from the output terminal N2. Accordingly, only the P-type transistor T21 and the N-type transistor T22 configuring the transmission gate TG2 are turned on. Accordingly, the pixel electrode 21 is electrically connected to the second control line S2.

By this circuit configuration, since the potentials applied to the first and second control lines S1 and S2 can be separately controlled by the common power source modulation circuit, the same potential can be applied to all the pixel electrodes although any one transmission gate is turned on.

Accordingly, it is possible to change the display state to the entirely black, the entirely white and the reverse image while maintaining the image data in the latch circuit (regardless of the maintenance data). The driver circuit does not need to be operated except when a new image is displayed and a flexible display method can be realized.

The description will be made with reference to FIG. 5.

According to the present embodiment, in the electrophoretic display device 1 having the latch circuit 25 and the transmission gates TG1 and TG2 in the pixel 20, since the high-potential power source line 78 and the low-potential power source line 77 connected to the latch circuit 25 cross each other at the first position of the pixel 20 and the first control line S1 and the second control line S2 connected to the transmission gates TG1 and TG2 cross each other at the second position of each pixel 20, it is possible to shorten the lines which are longitudinally crossed in the pixel 20, compared with the case where these lines are arranged in parallel. Accordingly, since a space occupied by the lines in the pixel 20 can be reduced, it is possible to form a high-precision pixel.

By reducing the space occupied by the lines in the pixel 20, since a margin is provided to the arrangement of the components in the pixel 20 in the same resolution and a margin is provided to a distance between the lines, it is possible to prevent yield from deteriorating due to the short circuit or static electricity in the process of manufacturing the electrophoretic display device 1.

The technical range of the invention is not limited to the above-described embodiment and may be properly changed without departing from the scope of the invention.

Figure 6:
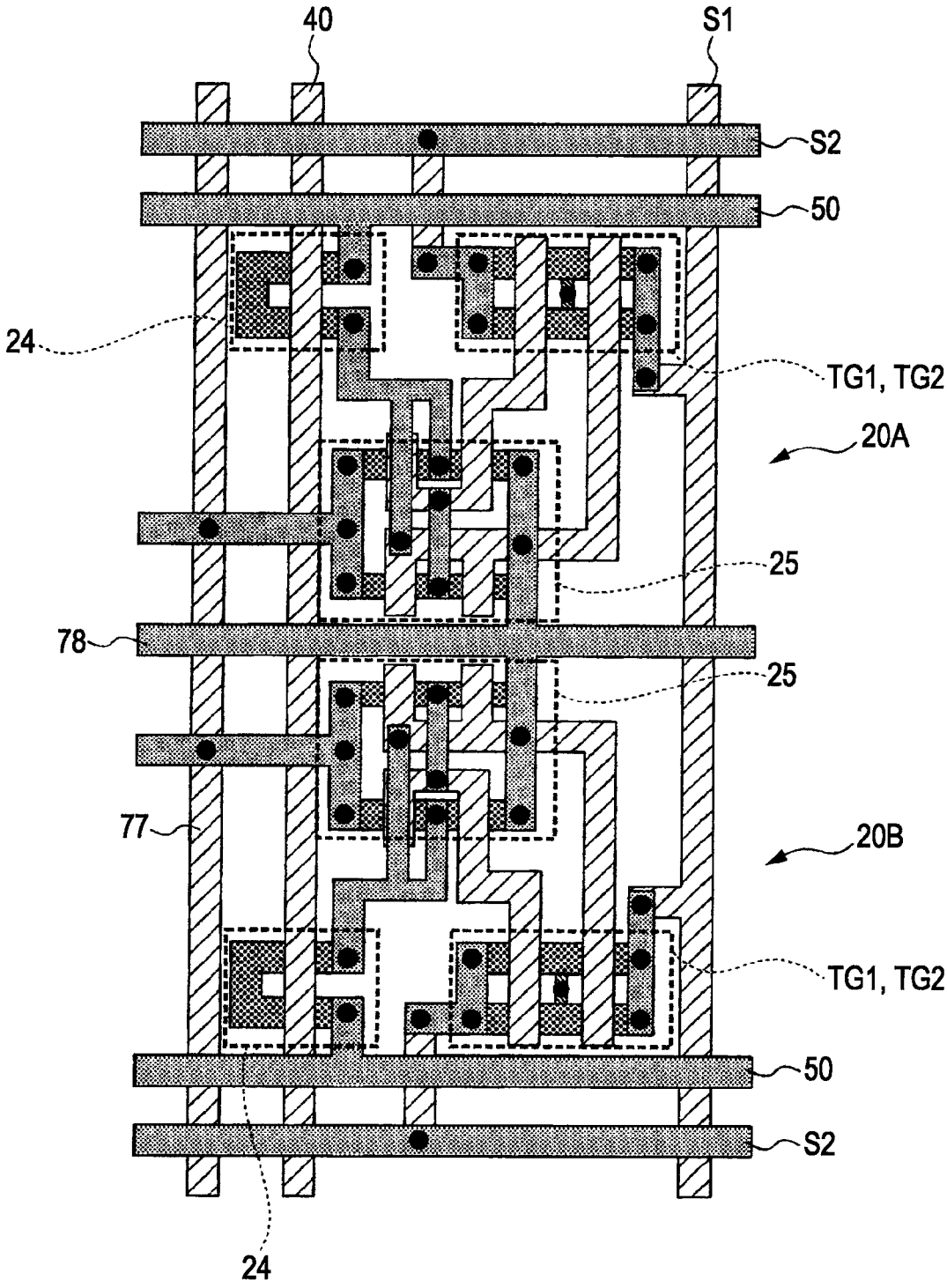
FIG. 6 is a plan view showing another configuration of one pixel of the electrophoretic display device according to the present embodiment.

For example, although, in the above-described embodiment, the six lines including the scan line 50, the data line 40, the high-potential power source line 78, the low-potential power source line 77, the first control line S1 and the second control line S2 are provided in each of the pixels 20, the invention is not limited thereto. For example, as shown in FIG. 6, any one (the high-potential power source line 78 in the example of FIG. 6) of the high-potential power source line 78, a low-potential power source line 77, the first control line S1 and the second control line S2 may be shared by adjacent pixels 20A and 20B. In the configuration shown in FIG. 6, the arrangement in the pixel 20A and the arrangement in the pixel 20B are linearly symmetrical with respect to the high-potential power source line 78. By this configuration, it is possible to reduce the number of high-potential power source lines 78 without significantly changing the substantial arrangement of the lines in the pixels. Accordingly, a wide space between the pixel 20A and the pixel 20B can be ensured and a margin can be provided to a distance between the lines formed in the pixel 20A and the pixel 20B.

Figure 7:
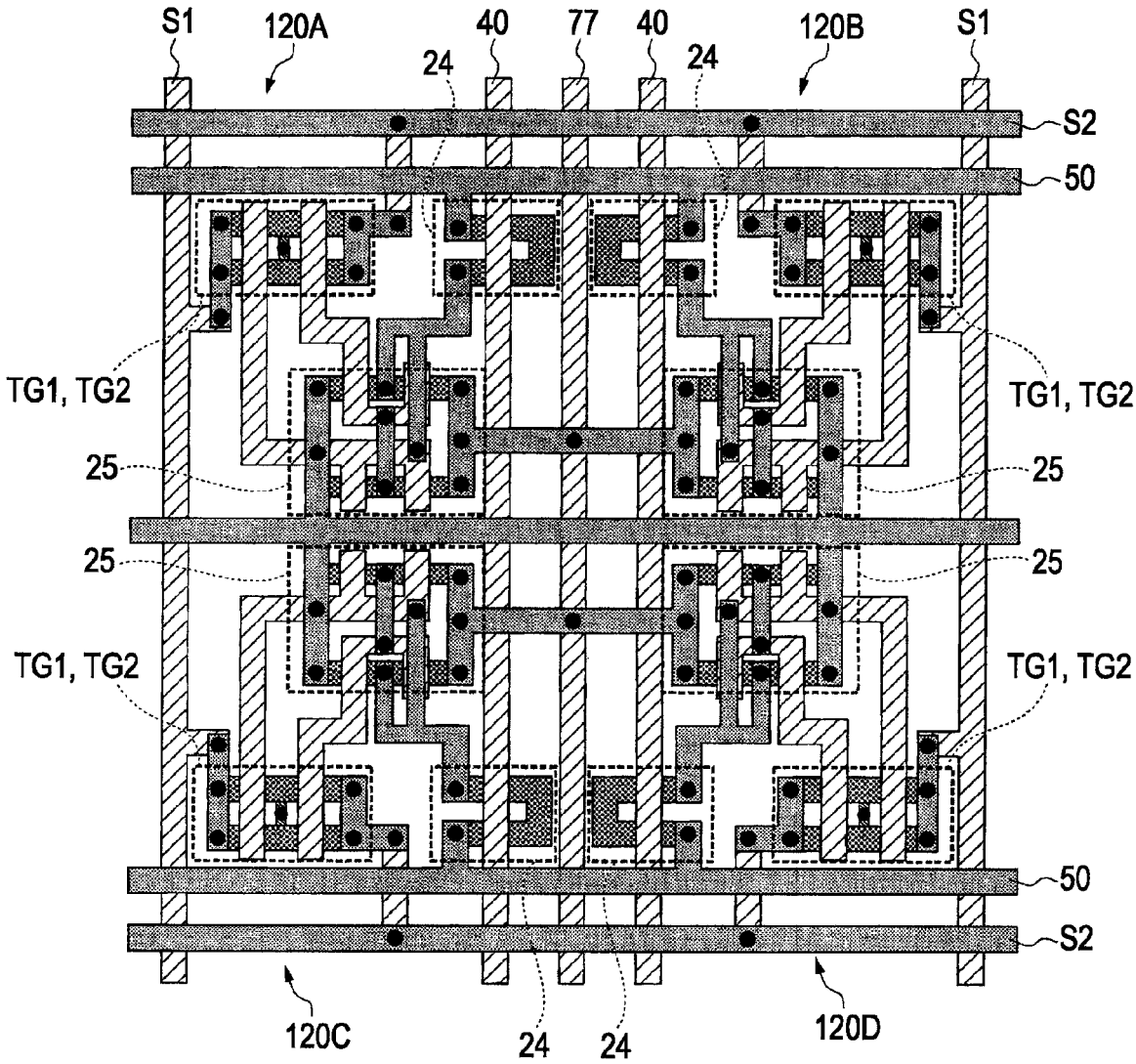
FIG. 7 is a plan view showing another configuration of one pixel of the electrophoretic display device according to the present embodiment.

In addition, as shown in FIG. 7, the two lines including the high-potential power source line 78 and the low-potential power source line 77 may be shared by adjacent pixels 120A, 120B, 120C and 120D. In this case, the arrangement in the pixel 120A and the arrangement in the pixel 120B are linearly symmetrical with respect to the low-potential power source line 77. Similarly, the arrangement in the pixel 120C and the arrangement in the pixel 120D are linearly symmetrical with respect to the low-potential power source line 77.

The arrangement in the pixel 120A and the arrangement in the pixel 120C are linearly symmetrical with respect to the high-potential power source line 78. Similarly, the arrangement in the pixel 120B and the arrangement in the pixel 120D are linearly symmetrical with respect to the high-potential power source line 78.

By this configuration, it is possible to reduce the number of high-potential power source lines 78 and the low-potential power source lines 77 without significantly changing the substantial arrangement of the lines in the pixels. Accordingly, a wide space between the pixels 120A to 120D can be ensured and a margin can be provided to a distance between the lines formed in the pixels 120A to 120D.

The entire disclosure of Japanese Patent Application No. 2008-017875, filed Jan. 29, 2008 is expressly incorporated by reference herein.

What is claimed is:

1. An electrophoretic display device comprising:

a pair of substrates;

a pixel;

a first electrode being formed on one of the substrates for the pixel;

a second electrode being formed on the other of the substrates;

an electrophoretic element including electrophoretic particles, the electrophoretic element being held between the first electrode and the second electrode;

a pixel switching element provided for the pixel, the pixel switching element being connected to a scan line and a data line;

a memory circuit provided for the pixel, the memory circuit being connected to the pixel switching element; and a switch circuit provided for the pixel, the switch circuit being interposed between the memory circuit and the first electrode;

wherein the memory circuit is connected with a first power source line and a second power source line, and the switch circuit is connected with a first control line and a second control line, wherein the first power source line and the second power source line cross each other at a first position of the pixel, and the first control line and the second control line cross each other at a second position of the pixel.

2. The electrophoretic display device according to claim 1, wherein:

the pixel has a rectangular shape in plan view, the first position corresponds to a first corner of the four corners of the pixel, and the second position corresponds to a second corner opposing the first corner of the four corners of the pixel.

3. The electrophoretic display device according to claim 2, wherein:

the memory circuit is provided in the vicinity of the first corner of the pixel, and the switch circuit is provided in the vicinity of the second corner of the pixel.

4. The electrophoretic display device according to claim 1, wherein at least one of the first power source line, the second power source line, the first signal line and the second signal line is shared by adjacent pixels.

5. The electrophoretic display device according to claim 4, wherein the arrangement of the adjacent pixels which share at least one of the first power source line, the second power source line, the first signal line and the second signal line in plan view are linearly symmetrical with respect to the shared line.

6. The electrophoretic display device according to claim 4, wherein the scan line and the data line are arranged to be closer to each of the pixels than the line, which is shared by the adjacent pixels, of the first power source line, the second power source line, the first signal line and the second signal line.

* * * * *